US007098762B2

(12) United States Patent
Wabner

(10) Patent No.: US 7,098,762 B2
(45) Date of Patent: Aug. 29, 2006

(54) ELECTROMECHANICAL SWITCH

(75) Inventor: Alf Wabner, Mittweida (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/525,217

(22) PCT Filed: Mar. 12, 2004

(86) PCT No.: PCT/EP2004/002618

§ 371 (c)(1),
(2), (4) Date: Feb. 22, 2005

(87) PCT Pub. No.: WO2004/088697

PCT Pub. Date: Oct. 14, 2004

(65) Prior Publication Data

US 2005/0219020 A1 Oct. 6, 2005

(30) Foreign Application Priority Data

Apr. 3, 2003 (DE) ..... 103 15 243

(51) Int. Cl.
*H01H 67/02* (2006.01)

(52) U.S. Cl. ..... 335/132; 335/202

(58) Field of Classification Search ..... 335/132, 335/202

See application file for complete search history.

(56) References Cited

U.S. PATENT DOCUMENTS 3,942,143 A * 3/1976 Pollmann et al. ..... 335/132

5,323,132 A * 6/1994 Abot et al. ..... 335/132

FOREIGN PATENT DOCUMENTS

| | | |
|---|---|---|
| DE | 912 597 | 5/1954 |
| DE | 1 254 737 | 11/1967 |
| DE | 1 901 965 | 8/1970 |
| DE | 31 05 117 C2 | 8/1982 |
| DE | 37 43 244 A1 | 6/1989 |
| DE | 197 29 595 C1 | 7/1997 |
| EP | 0 271 366 B1 | 6/1988 |
| GB | 640 755 | 7/1950 |

* cited by examiner

*Primary Examiner*—Lincoln Donovan
(74) *Attorney, Agent, or Firm*—Harness, Dickey & Pierce, P.L.C.

(57) ABSTRACT

An electromechanical switch includes a main contact provided with a number of main fixed contacts and a mobile main contact bridge; an auxiliary contact which precedes the main contact in the switch-on process and includes a number of auxiliary fixed contacts and a mobile auxiliary contact bridge; and a contact bridge carrier for actuating the main contact bridge and the auxiliary contact bridge. At least one of the contact parts is spring-mounted. The electromechanical switch has two stable positions of the auxiliary contact bridge or the auxiliary fixed contact. During the switching on process carried out by actuation of the contact bridge carrier via the auxiliary contact bridge or an auxiliary fixed contact in the first stable position, the auxiliary contact closes before the main contact, and during the switching off process by actuation of the contact bridge carrier in the opposite direction, the auxiliary contact with the auxiliary contact bridge or the auxiliary fixed contact in the second stable position opens before the main contact.

22 Claims, 4 Drawing Sheets

1
2
3
4
5
6
7
8
9
10
11

1
2
3
4
5
6
7
8
9
10
11

10
6
8
9
3
4
11
7
5
1
2
4

1
2
3
4
5
6
7
8
9
10
11

ELECTROMECHANICAL SWITCH

This application is the national phase under 35 U.S.C. § 371 of PCT International Application No. PCT/EP2004/002618 which has an International filing date of Mar. 12, 2004, which designated the United States of America and which claims priority on German Patent Application number DE 103 15 243.1 filed Apr. 3, 2003, the entire contents of which are hereby incorporated herein by reference.

FIELD OF THE INVENTION

The invention generally relates to an electromechanical switching device. In particular, it relates to a capacitor contactor.

BACKGROUND OF THE INVENTION

A switching device is known, for example, from DE 31 05 117 C2. The switching device known from DE 31 05 117 C2 has main contacts and leading contacts, also referred to as auxiliary contacts, which are interconnected with series damping resistors given a capacitive load.

The same also applies, for example, to a capacitor contactor known from DE 197 29 595 C1. When the switching device or capacitor contactor is switched on, initially the auxiliary contacts close such that a connected capacitor is initially pre-charged via the series damping resistors. This weakens the switch-on current peak when the main contacts close.

When the switching device is switched off, initially the main contacts open and thus disconnect such that there is virtually no current. Overall, switch-on arcs thus predominantly occur at the main contacts. Since such switch-on arcs lead to changes in the contact pieces, the risk of wear is increased. Furthermore, when the switching device is switched off, a relatively long arc-burning period results at the main contacts, which form a zero-current interrupter, as a result of which the life of the device is shortened.

In order to counteract these disadvantages, the actuation of the main contacts could be decoupled from the actuation of the auxiliary contacts. This would, however, require the switching mechanism to have a relatively complex design.

SUMMARY OF THE INVENTION

An embodiment of the invention includes an object of specifying an electromechanical, in particular electromagnetic, switching device having a main contact and an auxiliary contact which leads during the switch-on process, in particular for the purpose of reducing a switch-on current peak.

The switching device of an embodiment can include a simple design and particularly low wear owing to arcs on the main and/or auxiliary contact.

This switching device of one embodiment has a main contact which includes a number of, generally two, main fixed contacts and a moveable main contact bridge which can be connected to said main fixed contacts. In addition, the switching device has an auxiliary contact which closes early during the switch-on process and which analogously comprises a number of auxiliary fixed contacts and a moveable auxiliary contact bridge which can be connected to said auxiliary fixed contacts.

For the purpose of actuating both the main contact and the auxiliary contact, a contact bridge holder or carrier is provided which is mechanically connected to the two contact bridges. At least one of the contact parts (main fixed contact, main contact bridge, auxiliary fixed contact and auxiliary contact bridge) is mounted in a sprung manner.

The auxiliary contact bridge or the at least one auxiliary fixed contact may assume two stable positions which are defined, in the case of the bistable auxiliary contact bridge, relative to the contact bridge holder and, in the case of the bistable auxiliary fixed contact, relative to a rigid structure of the switching device. As the switching device is switched on, the auxiliary contact bridge or the auxiliary fixed contact is in the first position when the auxiliary contact closes and thus ensures the leading switching behavior of the auxiliary contact in relation to the main contact.

When the switching device is switched off, the auxiliary contact bridge or the auxiliary fixed contact is in the second stable position at least at the point in time at which the auxiliary contact opens. This also results in a leading switching behavior of the auxiliary contact during the switch-off process, i.e. the auxiliary contact opens before the main contact. The changeover between the first and the second stable position of the auxiliary contact bridge or the auxiliary fixed contact or the auxiliary fixed contacts takes place with the actuation of the contact bridge carrier.

In one embodiment of the switching device which can be implemented simply in design terms, the switching device is designed such that the auxiliary contact bridge can be electrically connected to the auxiliary fixed contacts when the contact bridge holder is actuated only in the first position of the auxiliary contact bridge or the auxiliary fixed contact. Whereas, in the second position of the auxiliary contact bridge or the auxiliary fixed contact, the auxiliary contact bridge is always separated from the auxiliary fixed contacts irrespective of the position of the contact bridge carrier.

When the electromechanical switching device is switched on, in accordance with a preferred refinement the auxiliary contact bridge or the auxiliary fixed contact is moved over from the first position to the second position by the contact bridge carrier being actuated once the main contact has closed, it is thus possible for the auxiliary contact to be open following completion of the switch-on process. During the switch-off process, the auxiliary contact bridge or the auxiliary fixed contact is thus initially in the second position. However, during the switch-off process, the auxiliary contact bridge or the auxiliary fixed contact, in turn triggered by the displacement of the contact bridge holder, by interacting with a stop provided for this purpose only changes to the first position once the main contact has opened.

Owing to the changeover of the auxiliary contact bridge or the auxiliary fixed contact during the switch-off process, the auxiliary contact is not closed again. The auxiliary contact thus remains out of operation throughout the switch-off process.

As a result of the fact that during the switch-off process only the main contact switches, an arc across the main contact typically occurs not only during the switch-on process but also during the switch-off process. In addition to protecting the auxiliary contacts, this has the advantage that any softened contact mass present on the main contact and formed by the switch-on arc melts over again, as a result of which there is a reduced risk of wear and thus the life of the switching device is lengthened. A simple design for the switching device is achieved by both the main contact bridge and the auxiliary contact bridge remaining coupled to the contact bridge holder during all switching processes.

A space-saving design for the switching device is preferably implemented by the main contact bridge and the auxiliary contact bridge being arranged at least approximately parallel to one another. The contact bridge holder is preferably arranged perpendicular to one of the contact bridges, in particular to the two contact bridges. In a manner known per se, the contact bridge is furthermore preferably mounted in a sprung manner in the contact bridge carrier, in particular using a spring arranged within the cross section of the contact bridge carrier. The design of the switching device in this regard largely corresponds in terms of embodiments, which have the mentioned features, to the design of a switching device which is known, for example, from DE 31 05 117 C2.

However, the mounting of the auxiliary contact bridge in or on the contact bridge carrier and/or the mounting of the auxiliary fixed contacts in the switching device differs from this known switching device. The auxiliary contact bridge in the switching device known from DE 31 05 117 C2 can only assume a single stable position, namely pushed by spring force in the direction of the main contact bridge. However, the switching device according to an embodiment of the invention, in accordance with a first alternative, includes two defined stable positions of the auxiliary contact bridge. In this case, the auxiliary contact bridge can be displaced, for example, relative to the contact bridge holder perpendicular to the contact bridge holder and, in particular with the assistance of spring force, can be latched into two different positions on the contact bridge holder.

However, in accordance with a particularly advantageous embodiment, the auxiliary contact bridge is mounted in or on the contact bridge carrier at a suspension point, which cannot be displaced relative to the contact bridge carrier, in a very simple manner in design terms. In this case, the auxiliary contact bridge must have an intrinsic ability to move at least slightly in order to be able to assume two different stable positions. The auxiliary contact bridge is preferably in the form of a snap-action spring which is mounted approximately centrally on the contact bridge carrier.

In accordance with a second alternative, the auxiliary contact bridge is of rigid design and is mounted in the contact bridge carrier such that it cannot be displaced. However, the auxiliary fixed contact, preferably two auxiliary fixed contacts arranged symmetrically with respect to the contact bridge carrier, is formed in a resilient manner with two possible stable positions. With this embodiment, the auxiliary fixed contact is advantageously in the form of a snap-action spring. However, an intrinsically rigid auxiliary fixed contact may also be provided which can assume two stable positions owing to the fact that it is mounted in the housing of the switching device such that it can move, for example be displaced or pivoted.

BRIEF DESCRIPTION OF THE DRAWINGS

Exemplary embodiments of the invention will be explained in more detail below with reference to a drawings, in which.

Mutually corresponding parts or parts having the same function are identified by the same reference numerals in all of the figures.

DETAILED DESCRIPTION OF THE EXEMPLARY EMBODIMENTS

Figures 1A, 1B, 1C, 1D:
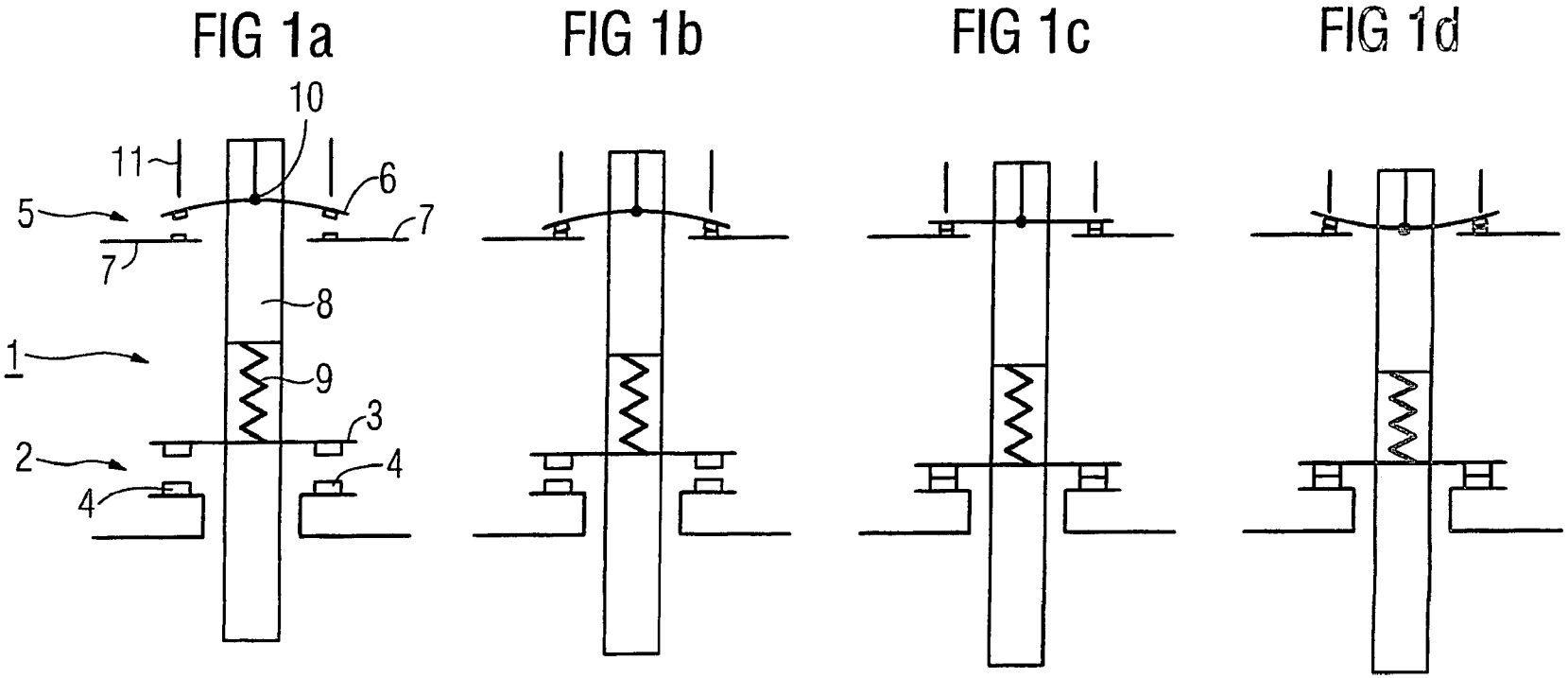
FIGS. 1*a* to 1*d* show schematic illustrations of a first embodiment of an electromechanical switching device during the switch-on process.

FIGS. 1*a* to 1*d* and 2*a* to 2*d* show very simplified cross-sectional detail illustrations of an electromechanical switching device 1 in the form of a capacitor contactor in different switching states. The switching device 1 has a main contact 2 having a main contact bridge 3 and main fixed contacts 4 as well as an auxiliary contact 5 having an auxiliary contact bridge 6 and auxiliary fixed contacts 7. A contact bridge carrier 8 is provided for the purpose of actuating the contact bridges 3, 6.

The main contact bridge 3 is mounted in the contact bridge carrier 8 such that it can be displaced by means of a compression spring 9. By a load being applied via the compression spring 9, the main contact bridge 3 can assume a single stable position relative to the contact bridge carrier 8, which is also referred to as a slide, namely pushed in the direction of the main fixed contacts 4.

The auxiliary contact bridge 6, in contrast to the main contact bridge 3, is connected to the contact bridge carrier 8 at a point which is fixed relative to the contact bridge carrier 8, namely at the suspension point 10. The auxiliary contact bridge 6 is in the form of a snap-action spring which can assume two stable positions. In order to change over between these two stable positions of the auxiliary contact bridge 6, firstly, in the illustration below the auxiliary contacts 6, the auxiliary fixed contacts 7 and secondly, in the illustration above the auxiliary contact bridge 6, two stops 11 are provided.

FIG. 1*a* shows the switching device 1 in the switched-off state. The auxiliary contact bridge 6 is located in the first position. When the switching device 1 is switched on by the contact bridge carrier 8 being displaced, at the bottom in the illustration, initially the auxiliary contact 5 closes (FIG. 1*b*).

In the further course of the contact bridge carrier 8 being actuated, the auxiliary contact bridge 6 temporarily assumes an unstable intermediate position. In this case the auxiliary contact 5 remains closed. With the auxiliary contact 5 closed, the main contact 2 now also closes (FIG. 1*c*). If the contact bridge carrier 8 is displaced further in the direction of the switch-on position as the spring 9 is compressed (FIG. 1*d*), also referred to as resilience, the auxiliary contact bridge 6, which is mounted at the suspension point 10 such that it cannot be displaced relative to the contact bridge carrier 8, snaps around, i.e. assumes its second stable position. In this second stable position of the auxiliary contact bridge 6, in the exemplary embodiment illustrated the auxiliary contact 5 is always open irrespective of the position of the contact bridge carrier 8.

When the switching device 1 is switched on, only the main contact 2 is thus closed. As a deviation from this embodiment, the auxiliary contact 5 may likewise remain closed even when the main contact 2 is closed and may only open during the switch-off process, before the main contact 2, i.e. such that it leads said main contact 2.

Figures 2A, 2B, 2C, 2D:
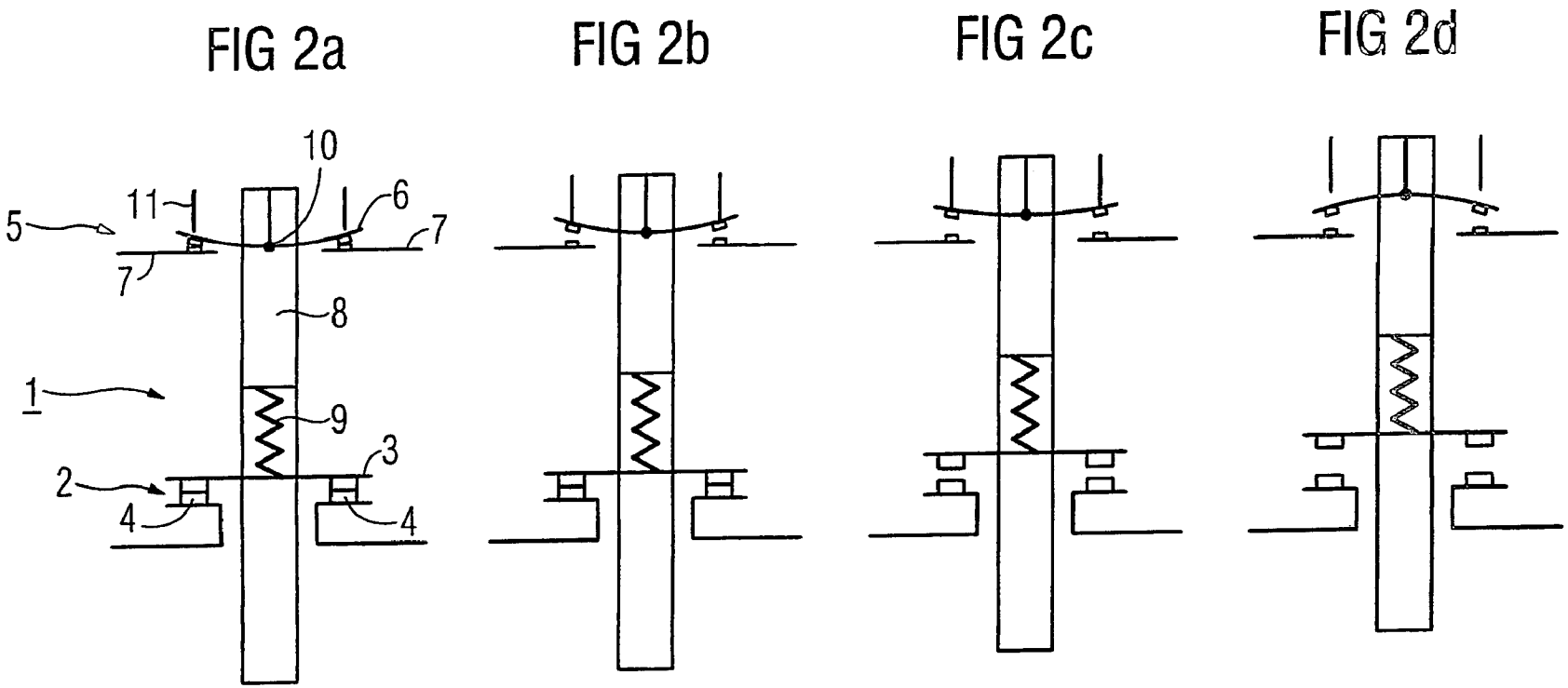
FIGS. 2*a* to 2*d* show schematic illustrations of the electromechanical switching device shown in FIGS. 1*a* to 1*d* during the switch-off process.

With reference to FIGS. 2*a* to 2*d*, the switch-off process of the switching device 1 will be explained below. The state of the switching device shown in FIG. 2*a* corresponds to the state shown in FIG. 1*d*. If the contact bridge carrier 8 is displaced in the direction of the switch-off position, upwards in the illustration, initially the auxiliary contact 5 opens as long as it was not already open (as in the exemplary embodiment), and then the main contact 2 (FIG. 2*c*). The auxiliary contact bridge 6 hits against the stop 11 as the main contact 2 opens and, triggered by the opening movement of the contact bridge carrier 8, snaps back around into the first stable state (FIG. 2*d*). However, the auxiliary contact bridge 6 is in this case already lifted so far up from the auxiliary fixed contacts 7 that the auxiliary contact 5 no longer closes. The auxiliary contact 5 thus remains open throughout the switch-off process in the exemplary embodiment. The switching position shown in FIG. 2*d* corresponds to the switching position shown in FIG. 1*a*.

FIGS. 3*a* to 3*d* and 4*a* to 4*d* show an alternative design for a switching device 1 which differs from the switching device shown in FIGS. 1*a* to 2*d* in terms of the configuration of the auxiliary contact 5. With the switching device shown in FIGS. 3*a* to 4*d*, the auxiliary contact bridge 6 is of rigid design, whereas the auxiliary fixed contacts 7 are of resilient design and can assume two stable positions. The auxiliary fixed contacts 7 are in this case clamped at one end in the housing (not shown) of the switching device 1.

FIGS. 3*a* to 3*d* show the switch-on process of the switching device 1. In their first stable position (FIG. 3*a*), the auxiliary fixed contacts 7 are bent slightly towards the auxiliary contact bridge 6 which is arranged above them in the illustration and is rigid and straight. The changeover to the second stable position of the auxiliary fixed contacts 7 (FIG. 3*d*) takes place in an analogous manner to the switching process shown in FIGS. 1*a* to 1*d*. If the contact bridge carrier 8 is located in the closed final position (FIG. 3*d*), the auxiliary contact 5 is open in the exemplary embodiment illustrated. Alternatively, the auxiliary contact 5 could, however, also remain closed.

Figures 3A, 3B, 3C, 3D:
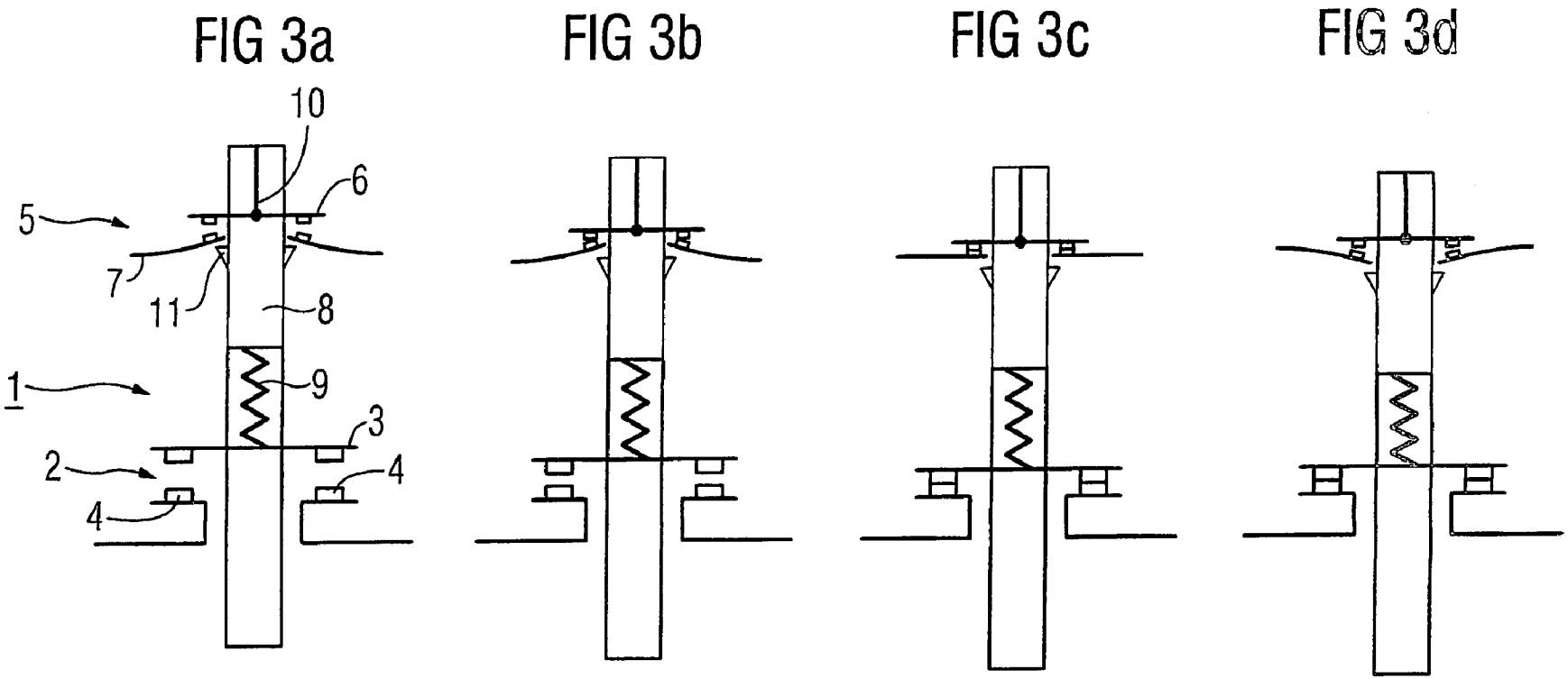
FIGS. 3*a* to 3*d* show schematic illustrations of a second embodiment of an electromechanical switching device during the switch-on process.
Figures 4A, 4B, 4C, 4D:
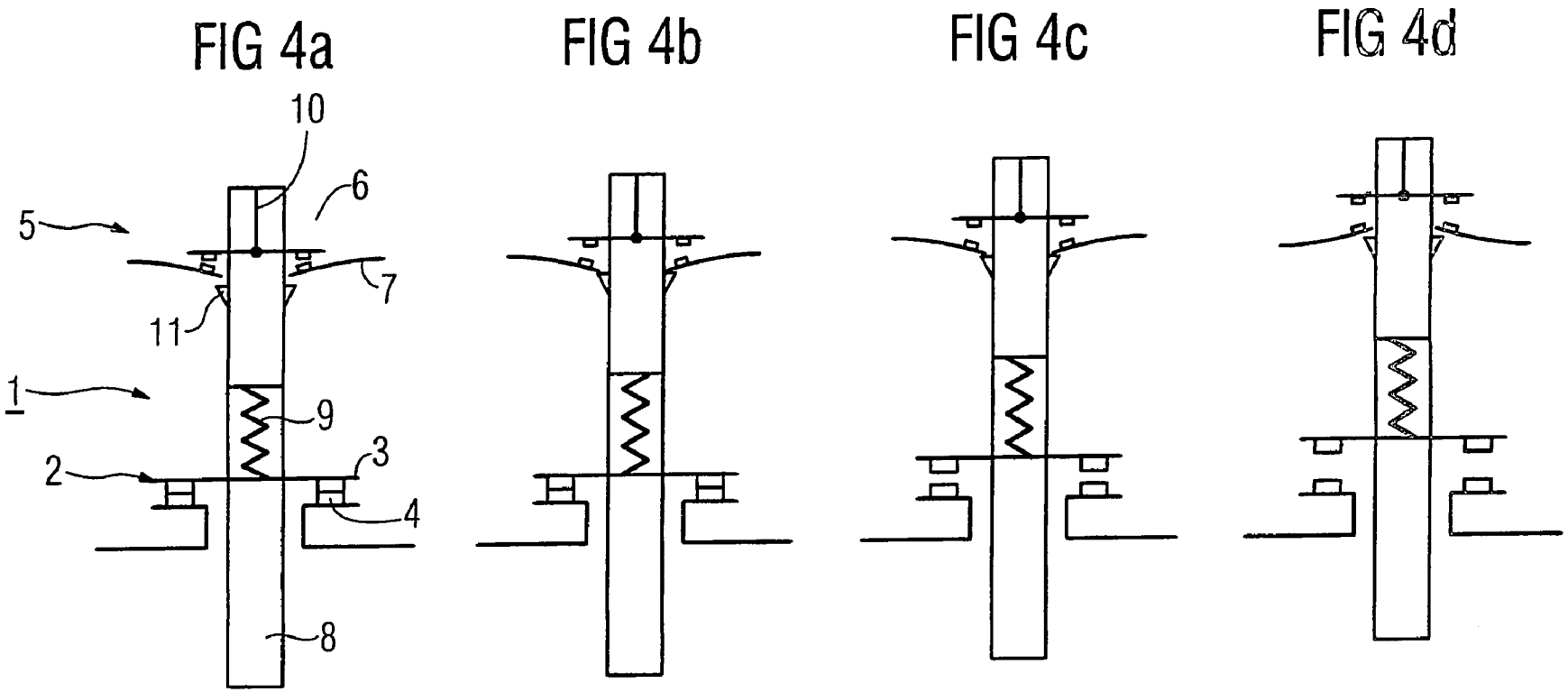
FIGS. 4*a* to 4*d* show schematic illustrations of the electromechanical switching device shown in FIGS. 3*a* to 3*d* during the switch-off process.

The switching position shown in FIG. 4*a*, which characterizes the beginning of the switch-off process, corresponds to the switching position shown in FIG. 3*d*. During the switch-off process, the stops 11, which are in this case fitted to the contact bridge carrier 8, come into operation. By use of the stops 11, the auxiliary fixed contacts 7 are moved over from their second stable position, in which they are deflected in the direction of the main contact 2 (FIG. 4*a*), into their first stable position (FIG. 4*d*). The auxiliary contact 5 remains open when the switching device 1 is switched off, analogously to FIGS. 2*a* to 2*d*. As a deviation from this, an opening of the auxiliary contact 5 could also only be provided during the switch-off process, but in any case before the opening of the main contact 2. The switching position shown in FIG. 4*d* corresponds to the switching position shown in FIG. 3*a*.

Exemplary embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

The invention claimed is:

1. An electromechanical switching device, comprising:

a main contact including a number of main fixed contacts and a moveable main contact bridge;

an auxiliary contact which leads during the switch-on process and which includes a number of auxiliary fixed contacts and a moveable auxiliary contact bridge; and a contact bridge carrier, provided for actuating the main contact bridge and the auxiliary contact bridge, wherein at least one of the contacts is mounted in a sprung manner, wherein the auxiliary contact bridge is elastically deformable between a first stable position and a second stable position relative to the contact bridge carrier, wherein, when the switching device is switched on, the auxiliary contact bridge in the first stable position closing the auxiliary contact which leads the main contact by the contact bridge carrier being actuated, and wherein, when the switching device is switched off, the auxiliary contact with the auxiliary contact bridge in the second stable position opening before the main contact by the contact bridge carrier being actuated in the opposite direction.

2. The switching device as claimed in claim 1, wherein, during the switch-on process, the auxiliary contact bridge is elastically deformed into the second stable position via the mechanical action of the auxiliary fixed contacts on the auxiliary contact bridge.

3. The switching device as claimed in claim 2, wherein, during the switch-on process, the change, which is triggered by the actuation of the contact bridge carrier, between the first and the second stable position of the auxiliary contact bridge once the main contact has closed, can trigger an opening of the auxiliary contact.

4. The switching device as claimed in claim 1, wherein, during the switch-off process, the auxiliary contact bridge is elastically deformed into the first stable position via the mechanical action of at least one stop on the auxiliary contact bridge.

5. The switching device as claimed in claim 1, wherein the auxiliary contact bridge is in the form of a snap-action spring.

6. An electromechanical switching device, comprising:

a main contact including a number of main fixed contacts and a moveable main contact bridge;

an auxiliary contact which leads during the switch-on process and which includes a number of auxiliary fixed contacts and a moveable auxiliary contact bridge; and a contact bridge carrier, for actuating the main contact bridge and the auxiliary contact bridge, wherein at least one of the contacts is mounted in a sprung manner, wherein at least one auxiliary fixed contact is elastically deformable between a first stable position and a second stable position, wherein, when the switching device is switched on, the auxiliary contact bridge making contact with the auxiliary fixed contact in the first stable position by the contact bridge carrier being actuated and in the process closing the auxiliary contact before the main contact, and wherein, when the switching device is switched off, the auxiliary contact with the auxiliary fixed contact in the second stable position opening before the main contact by the contact bridge carrier being actuated in the opposite direction.

7. The switching device as claimed in claim 6, wherein, during the switch-on process, the auxiliary fixed contact is elastically deformed into the second stable position via the mechanical action of the auxiliary contact bridge on the auxiliary fixed contact.

8. The switching device as claimed in claim 7, wherein, during the switch-on process, the change, which is triggered by the actuation of the contact bridge carrier, between the first and the second stable position of the auxiliary fixed contact once the main contact has closed, can trigger an opening of the auxiliary contact.

9. The switching device as claimed in claim 6, wherein, during the switch-off process, the auxiliary fixed contact is elastically deformed into the first stable position via mechanical action of at least one stop on the auxiliary fixed contact.

10. The switching device as claimed in claim 6, wherein the auxiliary fixed contact is in the form of a snap-action spring.

11. The switching device as claimed in claim 6, wherein two auxiliary fixed contacts are arranged at least approximately symmetrically with respect to the contact bridge carrier.

12. The switching device as claimed in claim 1, wherein the main contact bridge and the auxiliary contact bridge are arranged at least approximately parallel to one another.

13. The switching device as claimed in claim 1, wherein at least one of the contact bridges is arranged at least approximately perpendicular to the contact bridge carrier.

14. The switching device as claimed in claim 1, wherein the auxiliary contact bridge is mounted in the contact bridge carrier at a suspension point, which cannot be displaced relative to the contact bridge carrier.

15. The switching device as claimed in claim 2, wherein, during the switch-off process, the auxiliary contact bridge is elastically deformed into the first stable position via the mechanical action of at least one stop on the auxiliary contact bridge.

16. The switching device as claimed in claim 3, wherein, during the switch-off process, the auxiliary contact bridge is elastically deformed into the first stable position via the mechanical action of at least one stop on the auxiliary contact bridge.

17. The switching device as claimed in claim 7, wherein, during the switch-off process, the auxiliary fixed contact is elastically deformed into the first stable position via mechanical action of at least one stop on the auxiliary fixed contact.

18. The switching device as claimed in claim 8, wherein, during the switch-off process, the auxiliary fixed contact is elastically deformed into the first stable position via mechanical action of at least one stop on the auxiliary fixed contact.

19. The switching device as claimed in claim 6, wherein the main contact bridge and the auxiliary contact bridge are arranged at least approximately parallel to one another.

20. The switching device as claimed in claim 6, wherein at least one of the contact bridges is arranged at least approximately perpendicular to the contact bridge carrier.

21. The switching device as claimed in claim 6, wherein the auxiliary contact bridge is mounted in the contact bridge carrier at a suspension point, which cannot be displaced relative to the contact bridge carrier.

22. An electromechanical switching device, comprising:

a main contact including a main fixed contact and a moveable main contact bridge;

an auxiliary contact which leads during a switch-on process and which includes an auxiliary fixed contact and a moveable auxiliary contact bridge; and a contact bridge carrier for actuating the main contact bridge and the auxiliary contact bridge, wherein one of the auxiliary fixed contact and the auxiliary contact bridge is a deformable contact that is elastically deformable between a first stable position and a second stable position, wherein, when the switching device is switched on, the auxiliary contact, which has the deformable contact in the first stable position, closes the auxiliary contact before the main contact is closed, and wherein, when the switching device is switched off, the auxiliary contact, which has the deformable contact in the second stable position, opens before the main contact is opened.

* * * * *